US007724133B2

(12) United States Patent
Laitta et al.

(10) Patent No.: US 7,724,133 B2
(45) Date of Patent: May 25, 2010

(54) POOL VIDEO SAFETY, SECURITY AND INTRUSION SURVEILLANCE AND MONITORING SYSTEM

(75) Inventors: Rich Laitta, Lake Oswego, OR (US); Brett Fritts, West Linn, OR (US)

(73) Assignee: S. R. Smith LLC, Canby, OR (US)

( * ) Notice: Subject to any disclaimer, the term of this patent is extended or adjusted under 35 U.S.C. 154(b) by 236 days.

(21) Appl. No.: 11/829,860

(22) Filed: Jul. 27, 2007

(65) Prior Publication Data

US 2008/0048870 A1 Feb. 28, 2008

Related U.S. Application Data

(60) Provisional application No. 60/820,584, filed on Jul. 27, 2006.

(51) Int. Cl.
*G08B 13/00* (2006.01)

(52) U.S. Cl. ..... 340/565; 340/541

(58) Field of Classification Search ..... 340/565, 340/573.6, 541, 561
See application file for complete search history.

(56) References Cited

U.S. PATENT DOCUMENTS

| | | | | |
|---|---|---|---|---|
| 5,886,630 | A * | 3/1999 | Menoud | 340/540 |
| 6,642,847 | B1 * | 11/2003 | Sison | 340/565 |
| 7,138,921 | B1 | 11/2006 | Fontaine | |
| 7,174,005 | B1 * | 2/2007 | Rodkey et al. | 379/88.12 |
| 7,330,123 | B1 * | 2/2008 | Grahn et al. | 340/573.6 |

* cited by examiner

*Primary Examiner*—Toan N Pham
(74) *Attorney, Agent, or Firm*—patenttm.us

(57) ABSTRACT

A pool safety sensing system to attempt to reduce the likelihood of drowning visually observes a zone with a camera, and if detected motion occurs, and alarm is generated. The alarm can be visible, audible, text based (email, with or without attached images, instant message) or telephonic. Alarm events can be stored for future reference. Zones of sensing or zones to ignore when monitoring may be defined in the field of view of the camera. Motion thresholds, such as size of moving object, speed of movement, can be employed to adapt to particular location requirements and types of sensing.

22 Claims, 2 Drawing Sheets

POOL VIDEO SAFETY, SECURITY AND INTRUSION SURVEILLANCE AND MONITORING SYSTEM

BACKGROUND OF THE INVENTION

This invention relates to swimming pool safety, security and intrusion detection, and more particularly to a video analysis based surveillance system for watching swimming pool area activity.

Some 248 children drown annually in swimming pools, typically as a result of unmonitored children entering the pool area when adults are not present and falling into the pool. 2054 hospital emergency rooms visits related to near-drowning incidents occurred in a recent year, 42% of those requiring hospitalization, with medical costs ranging from $20,000 to $150,000, depending on the severity of the incident.

These pool accidents can happen quickly. 75% of the victims noted above were missing less than 5 minutes.

Typical home security monitoring systems are not suitable for addressing this problem, as they employ remote central station monitoring, which can be slow to respond (or not respond at all). Such remote stations result in notification that is too late given the short response window required to prevent permanent injury to a drowning victim, as brain damage can occur within 3 minutes of drowning.

In an attempt to address the issue of unattended child or unauthorized pool access, alarm systems for swimming pools are available. These systems include water disturbance or displacement detectors which determine when either the surface or subsurface of the water moves or is displaced as a result of a person entering the pool water. Such detector systems have disadvantages, being susceptible to false alarms. Also, since such an alarm does not activate until after the child is in the water, the alarm response is reactive rather than preventive and critical time is lost.

Mechanical safety systems may also be employed, such as fencing the pool area to prevent access to the pool area and/or pool covers to prevent access to the water. These types of solutions do not provide any notification of entry to the pool or pool area, can be expensive to install, require active participation (e.g., locking a gate or installing the cover after each use of the pool), and can be intrusive to the yard (aesthetically unpleasing fencing, for example).

SUMMARY OF THE INVENTION

In accordance with the invention, a system employing video monitoring of a pool area, with movement recognition and adaptability to different needs is provided.

Accordingly, it is an object of the present invention to provide an improved system for reducing the likelihood of accidental drowning of unsupervised children.

It is a further object of the present invention to provide an improved pool safety observation system for alerting of unauthorized access to the pool area.

It is an object of the present invention to provide an improved pool safety security system for alerting of unauthorized access to the pool area.

It is yet another object of the present invention to provide an improved swimming pool sensing system to detect movement around a pool zone.

The subject matter of the present invention is particularly pointed out and distinctly claimed in the concluding portion of this specification. However, both the organization and method of operation, together with further advantages and objects thereof, may best be understood by reference to the following description taken in connection with accompanying drawings wherein like reference characters refer to like elements.

DETAILED DESCRIPTION

The system according to a preferred embodiment of the present invention comprises a sensing system adapted to define sensing areas and events that would result in an alarm condition, suitably via video analysis sensing. Multiple alarm actions and notifications can be selected. The system may be employed for safety, security and intrusion detection.

Figure 1:
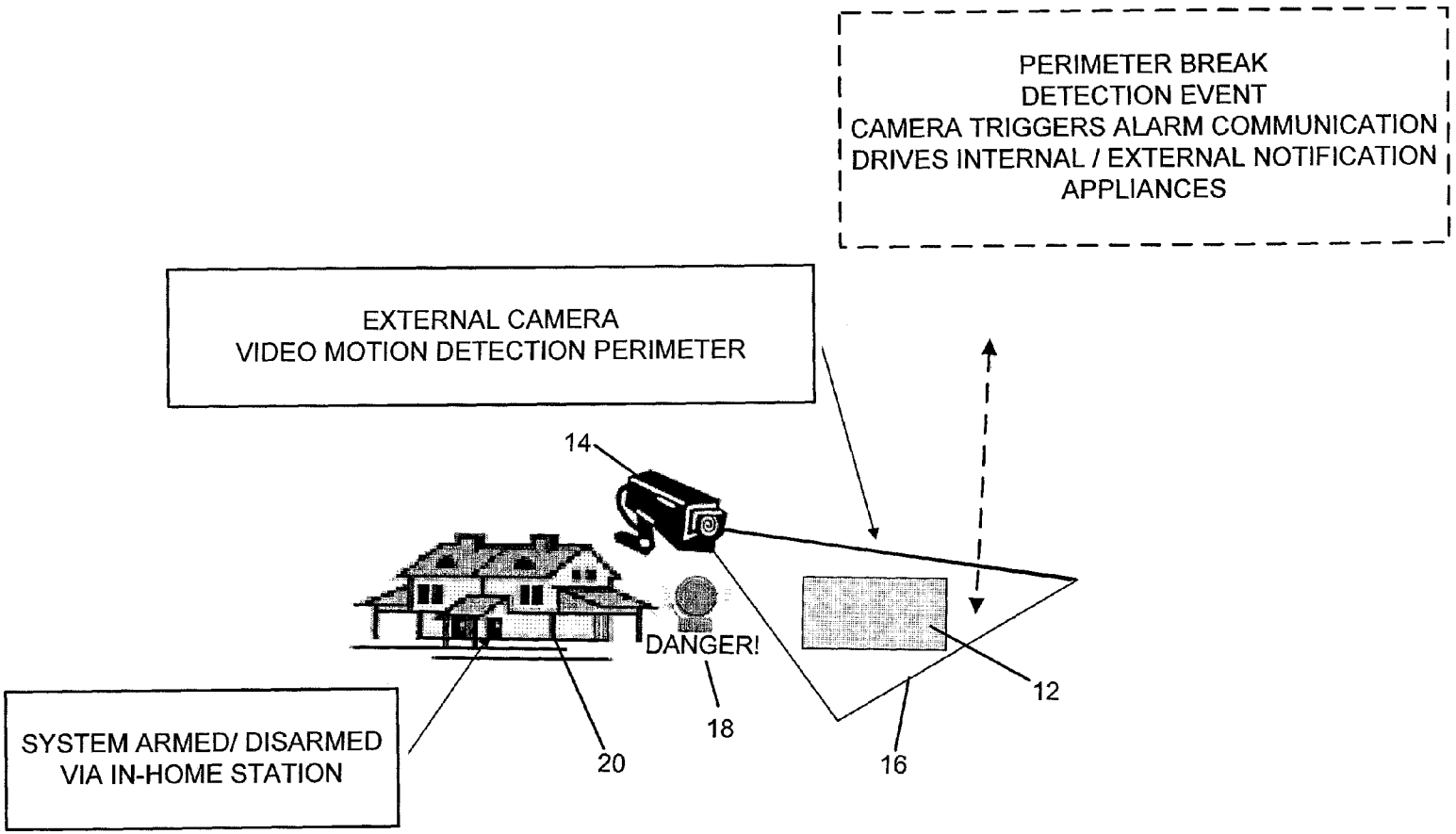
FIG. 1 is a schematic view of a system according to the invention.

Referring to FIG. 1, a schematic diagram of a sensing system, a swimming pool 12 is observed by one or more video cameras 14 which observe the pool area. A observation perimeter 16 (or multiple such perimeters or zones) is defined around the pool such that upon detection of certain movement or events through the perimeter, an alarm communication is made to drive an internal and/or external notification process. Such notification may include triggering an audible alarm 18, for example. The system is suitably armed or disarmed from house 20, or via a pool side control (not shown). The monitoring zones may be set by selection of an area or areas on a video display or displays that show the monitored views visible by the cameras 14. Such selection of areas may be defined by operation of a mouse or other suitable pointing or motion devices to draw or define zones which define monitored zones that are considered when determining alarm conditions or ignored zones that are disregarded when determining alarm conditions. Individual monitored (or ignored) zones may be set to different levels of sensitivity such that different degrees of motion or size of moving objects may be set that are required in a monitored zone or ignored zone to generate an alarm condition.

Figure 2:
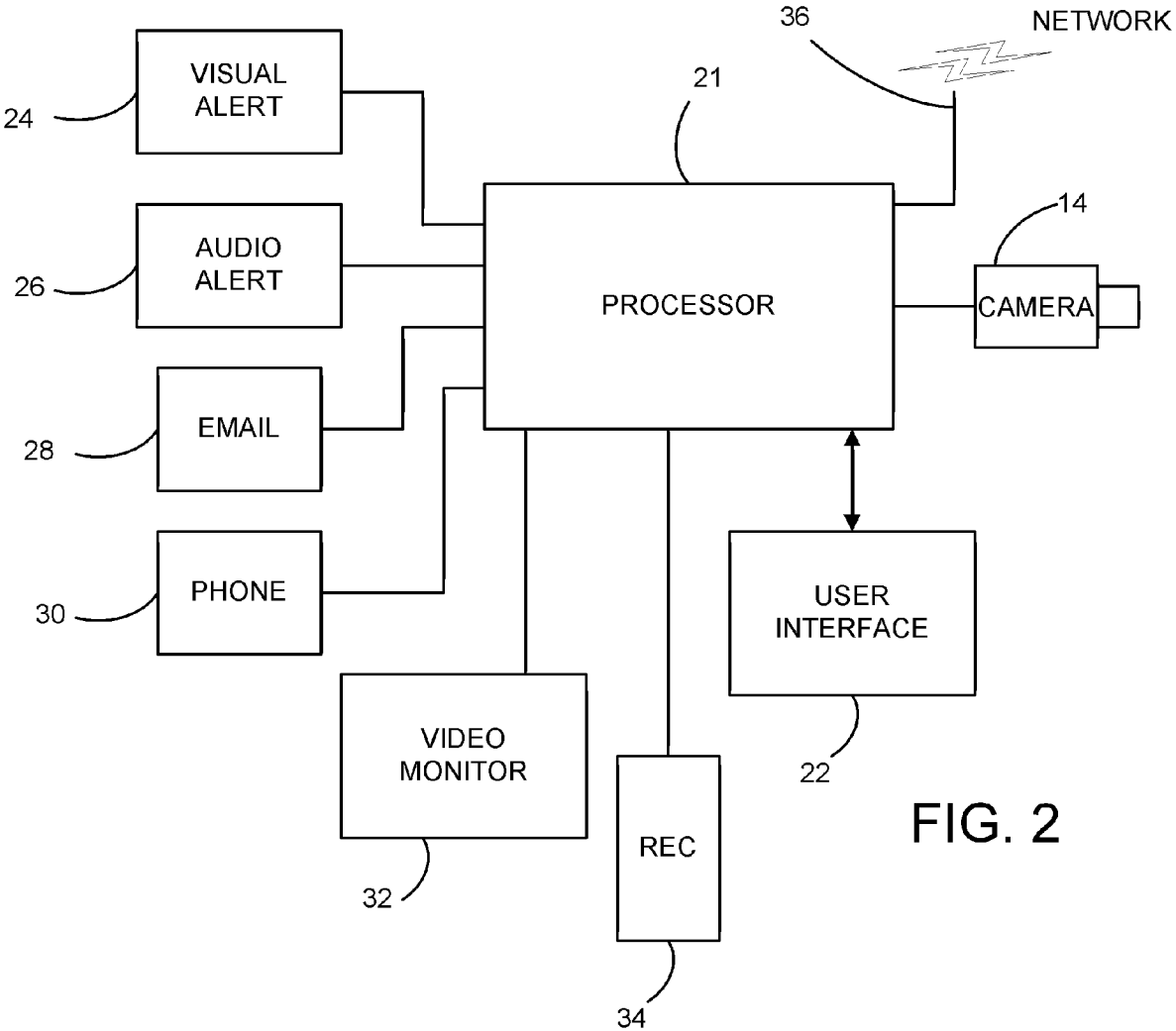
FIG. 2 is a block diagram of a sensing system according to the invention.

Referring now to FIG. 2, a block diagram of an exemplary system, the camera 14 (or cameras) is suitably positioned to have a view of the area being observed, which in the illustrated application is a swimming pool area. The output of the camera is supplied to a processor 21 via such video processing/conversion circuits as may be required. The processor interacts with a user interface which enables setting of features and activation of the system, as well as display of status or information to a user. The processor further interfaces with a visual alert 24, an audio alert 26, an email (or other computer network communication such as instant messaging, file transfer, etc.) alert 28 and a telephone alert 30.

On detection of an alert condition as viewed by camera 14 and interpreted by processor 21, an alarm may be sounded to indicate that someone has entered the sensing area. The alerts can suitably be one or more of a visual alert (flashing light, for example), audio alter (horn, bell, other sound alert), and email or other network communication alert, and a telephone alert, which might call one or more phone numbers (cell phone, neighbor's home, etc.) to deliver an alert message. The network alert can be an instant message, an email with attached images selected from the images from the camera that resulted in the alert.

The system can further include a video monitor 32, for example, to enable viewing of the image being supplied by the camera from a location remote from the pool. Further, a recorder 34 may be provided to record the images supplied by the camera 14. Recording can be done on a continuous basis, or only when an event is detected. Events can be archived if desired, storing a certain number of events, e.g., the last 5 or 10 events, or specific events can be saved indefinitely.

The detected events will typically be motion in the field of view of the camera(s). This can comprise motion crossing a certain defined perimeter in the view, which may be set by the user, or any motion within a particular zone or zones defined in the field of view of the camera. The amount of motion or size of object moving that is required to trigger an event may be adjusted, so that, for example, a small bird flying through the camera field of view will not register as an event, but a human child or adult moving will be large enough to be interpreted as an alarm event. Further, the speed at which movement is occurring may be a factor to determine whether an alarm event has taken place. For example, a high speed movement might be considered to not be an alarm event, so that an animal running through would not generate an alarm, but a much slower moving object, which might represent a small child crawling along, would generate an alarm.

The system may further be provided with an interface 36 adapted to connect to a network or other remote access technology, to enable remote testing, servicing or control, for example.

The processor provides the ability to separate foreground and background, wherein the system can be setup to learn the background objects in the view of the camera, being able to ignore movement or slight change in the background, while detecting foreground activity. Further, areas in the field of view can be masked off or on so as to be ignored or specifically observed, as desired and necessary according to the particular installation. So, for example, if one portion of the view of the camera is of a high traffic area that is out of the pool perimeter of concern, such as a walkway, the user can select that portion of view and instruct the system to ignore movement in that area, so as to not generate false alarms.

In accordance with the invention, a system is provided to afford increased pool safety to reduce the likelihood of unattended children drowning, particularly in residential swimming pool environments. Various types of alarms and alerts may be selected, as well as recording/archiving of events. System sensitivity, types of events suitable for alert and sensing zones can be adjusted to accommodate individual location factors. The system is also suitable for security monitoring of a pool and for intrusion detection.

While a preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

What is claimed is:

1. A swimming pool safety sensing system, comprising:

at least one camera for observing a zone outside of the pool water including an observation perimeter adjacent a swimming pool; and a processing system for receiving input from the camera and detecting motion, and determining whether said detected motion warrants an alarm condition, and effecting an alarm condition if warranted, wherein said processor further comprises adjustment control to enable adjustment or selection of monitoring parameters.

2. The swimming pool safety sensing system according to claim 1, wherein said detected motion warrants an alarm condition if a level of motion is detected passing through a perimeter.

3. The swimming pool safety sensing system according to claim 1, wherein said adjustment of monitoring parameters comprises selection of types of motion employed in determining whether an alarm event has taken place.

4. The swimming pool safety sensing system according to claim 1, wherein said adjustment of monitoring parameters comprises selection of amount or degrees of motion employed in determining whether an alarm event has taken place.

5. A swimming pool safety sensing system, comprising:

at least one camera for observing a zone including a swimming pool; and a processing system for receiving input from the camera and detecting motion, and determining whether said detected motion warrants an alarm condition, and effecting an alarm condition if warranted, wherein said processor further comprises threshold adjustment control to enable selection of types of motion or degrees of motion thresholds to employ in determining whether an alarm event has taken place.

6. The swimming pool safety sensing system according to claim 5, further comprising:

said effected alarm condition comprises activation of an audible alarm.

7. The swimming pool safety sensing system according to claim 5, further comprising:

said effected alarm condition comprises activation of a visible alarm.

8. The swimming pool safety sensing system according to claim 5, further comprising:

said effected alarm condition comprises activation of a network based alarm.

9. The swimming pool safety sensing system according to claim 8, wherein said network based alarm comprises an email.

10. The swimming pool safety sensing system according to claim 9, wherein said email further includes images from said camera.

11. The swimming pool safety sensing system according to claim 8, wherein said network based alarm comprises an instant message.

12. The swimming pool safety sensing system according to claim 5, further comprising:

said effected alarm condition comprises placing a telephone call.

13. The swimming pool safety sensing system according to claim 5, further comprising:

a recording system for recording and/or storing images from camera.

14. The swimming pool safety sensing system according to claim 5, comprising plural said cameras.

15. A swimming pool safety sensing system, comprising:

at least one camera for observing a zone including a swimming pool; and a processing system for receiving input from the camera and detecting motion, and determining whether said detected motion warrants an alarm condition, and effecting an alarm condition if warranted, wherein said processor further comprises monitored zone adjustment control to enable selection of one or more areas in view of the camera that are to be monitored for motion or that are to be ignored when monitoring for motion.

16. A method of safety observing a swimming pool for prevention of accidental drowning by unsupervised children, comprising:

providing a camera to view an area including at least a portion of the swimming pool and providing image data from said camera to a processor;

processing the image data from the camera to detect certain types of motion within at least a portion of the field of view of the camera; and generating an alarm if an alarm type of motion is detected, further comprising providing the function to mask off portions of the viewed area wherein motion within said masked off portions may be ignored for purposes of alarm generation.

17. The method according to claim 16, wherein said certain type of motion comprises motion passing through a perimeter defined within the field of view.

18. The method according to claim 16, wherein said certain type of motion comprises detecting motion within a zone including the water portion of the swimming pool.

19. The method according to claim 16, further comprising setting at least one zone within the field of view wherein motion in the at least one zone is not motion that will generate an alarm condition.

20. The method according to claim 16, further comprising setting a threshold of type of motion required to generate an alarm condition.

21. The method according to claim 16, wherein plural cameras are employed and processing of the image data is performed on at least portions of field of view from one or more of said cameras.

22. A swimming pool safety sensing system, comprising:

at least one camera for observing a zone including a swimming pool; and a processing system for receiving input from the camera and detecting motion, and determining whether said detected motion warrants an alarm condition, and effecting an alarm condition if warranted, further comprising a mask setting system for setting masked off regions in a monitored zone to be ignored when detecting alarm conditions.

* * * * *